US011753863B2

(12) United States Patent
Comaglio

(10) Patent No.: US 11,753,863 B2
(45) Date of Patent: Sep. 12, 2023

(54) DROP DOWN SEAL FOR DOORS OR WINDOWS WITH SLIDING PANEL

(71) Applicant: COMAGLIO S.R.L., Brescia (IT)

(72) Inventor: Cesare Comaglio, Brescia (IT)

(73) Assignee: COMAGLIO S.R.L., Brescia (IT)

( * ) Notice: Subject to any disclaimer, the term of this patent is extended or adjusted under 35 U.S.C. 154(b) by 78 days.

(21) Appl. No.: 17/433,102

(22) PCT Filed: Mar. 11, 2020

(86) PCT No.: PCT/IB2020/052151

§ 371 (c)(1),
(2) Date: Aug. 23, 2021

(87) PCT Pub. No.: WO2020/183387

PCT Pub. Date: Sep. 17, 2020

(65) Prior Publication Data

US 2022/0098926 A1 Mar. 31, 2022

(30) Foreign Application Priority Data

Mar. 12, 2019 (IT) ..... 102019000003599

(51) Int. Cl.
*E06B 7/21* (2006.01)
*E06B 3/46* (2006.01)

(52) U.S. Cl.
CPC ..... *E06B 7/21* (2013.01); *E06B 3/4636* (2013.01)

(58) Field of Classification Search
CPC ..... E06B 7/21; E06B 3/4636; E06B 3/4654; E06B 2007/202
See application file for complete search history.

(56) References Cited

U.S. PATENT DOCUMENTS

2018/0320437 A1* 11/2018 Dintheer ..... E06B 3/4609

FOREIGN PATENT DOCUMENTS

| | | |
|---|---|---|
| EP | 2476856 A2 | 7/2012 |
| JP | 3048537 B2 | 6/2000 |
| WO | 2018128824 A1 | 7/2018 |

OTHER PUBLICATIONS

English Translation of JP3048537 from WIPO (Year: 1998).*
International Search Report for International Patent Application No. PCT/IB2020/052151, dated Jun. 18, 2020.

* cited by examiner

*Primary Examiner* — Janet M Wilkens
*Assistant Examiner* — Susan M. Heschel
(74) *Attorney, Agent, or Firm* — CANTOR COLBURN LLP

(57) ABSTRACT

A drop down seal is provided which has a channel-shaped external support profile configured to be fixed to a base of a panel of a door or window, a rod-shaped support element slidably housed in the channel-shaped external support profile and a movable element connected to the rod-shaped support element by a parallelogram articulation mechanism allowing the movable element to move in height between a raised rest position and a lowered working position. The movable element, when in the raised rest position, is also operationally and removably connected to the channel-shaped external support profile. The rod-shaped support element, at a proximal end thereof, forms, or is provided with, a laterally protruding control portion configured to be engaged by a trigger base fixed to an abutment surface.

10 Claims, 15 Drawing Sheets

DROP DOWN SEAL FOR DOORS OR WINDOWS WITH SLIDING PANEL

CROSS-REFERENCE TO RELATED APPLICATIONS

This application is a National Phase Application of PCT International Application PCT/IB2020/052151, having an International Filing Date of Mar. 11, 2020 which claims priority to Italian Application No. 102019000003599 filed Mar. 12, 2019, each of which is hereby incorporated by reference in its entirety

TECHNICAL FIELD

The present disclosure relates to a drop down seal for doors, windows and flaps, particularly of the type with a sliding panel.

BACKGROUND

Drop down seals are already known that are fitted at the base of the hinged panel of a door.

These seals usually comprise a sealing element fixed to a support movable in height between an inactive raised position and a lowered working position, in which it is placed in contact with the floor.

For its movement, the movable support is fixed to a parallelogram articulation mechanism equipped with an actuation button which, as it protrudes from the panel, when the panel is closed the button is pressed by the hinge of the door into an advanced position that causes a rotation of the parallelogram articulation mechanism and then the descent of the movable support.

For the return of the movable support to the raised position, the drop down seal is usually equipped with return springs that counter the action of the button.

This embodiment of the drop down seal is not, for example, applicable to all sliding doors without a lock that keeps the door shut, since the return springs would cause the actuation button to return to the position of protrusion from the panel and would therefore prevent the door from being kept in the completely closed position. The effect of the drop down seal would thus be completely compromised.

BRIEF SUMMARY

The aim of the present disclosure is to propose a drop down seal that can also be applied to doors or windows with a sliding panel and without a lock.

This aim is achieved by a drop down seal and a drop down seal kit as described herein. disclosure

BRIEF DESCRIPTION OF THE DRAWINGS

The characteristics and advantages of the drop down seal and the kit according to the disclosure will emerge clearly from the following description of preferred embodiments, given by way of non-limiting examples, with reference to the accompanying figures, in which.

DETAILED DESCRIPTION

In said drawings, 1 indicates as a whole a drop down seal according to the disclosure.

The drop down seal 1 works in association with a trigger base 2 fixed to the abutment surface on which the drop down seal acts, the floor for example, as will be described below.

The subject matter of the present disclosure therefore relates both to the single drop down seal 1 and to the drop down seal kit that comprises the drop down seal 1 and the trigger base 2.

Figure 1:
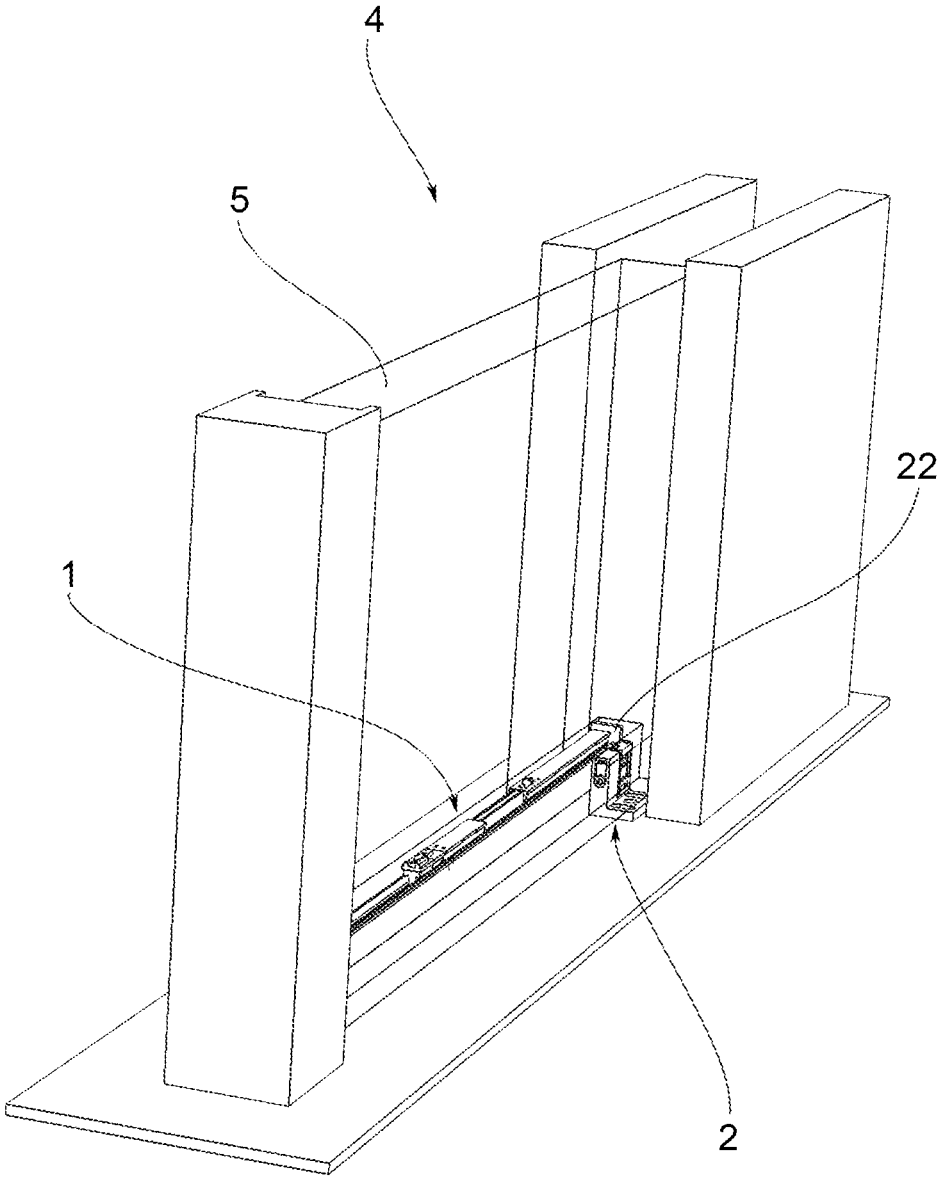
FIG. 1 is a transparent perspective view of an embodiment of a sliding door provided with the drop down seal kit according to the disclosure.
Figure 2:
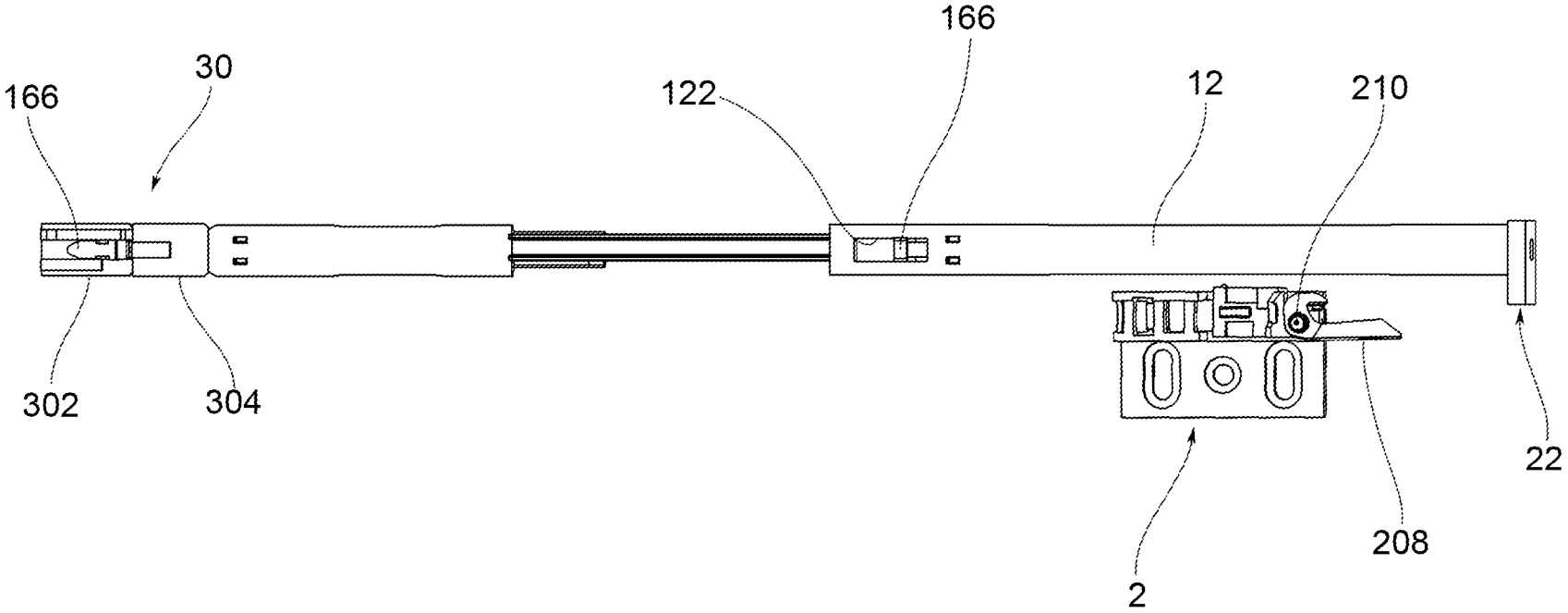
FIG. 2 is a top plan view of the drop down seal, without the external support profile, and relative trigger base, disengaged from one another.
Figure 3:
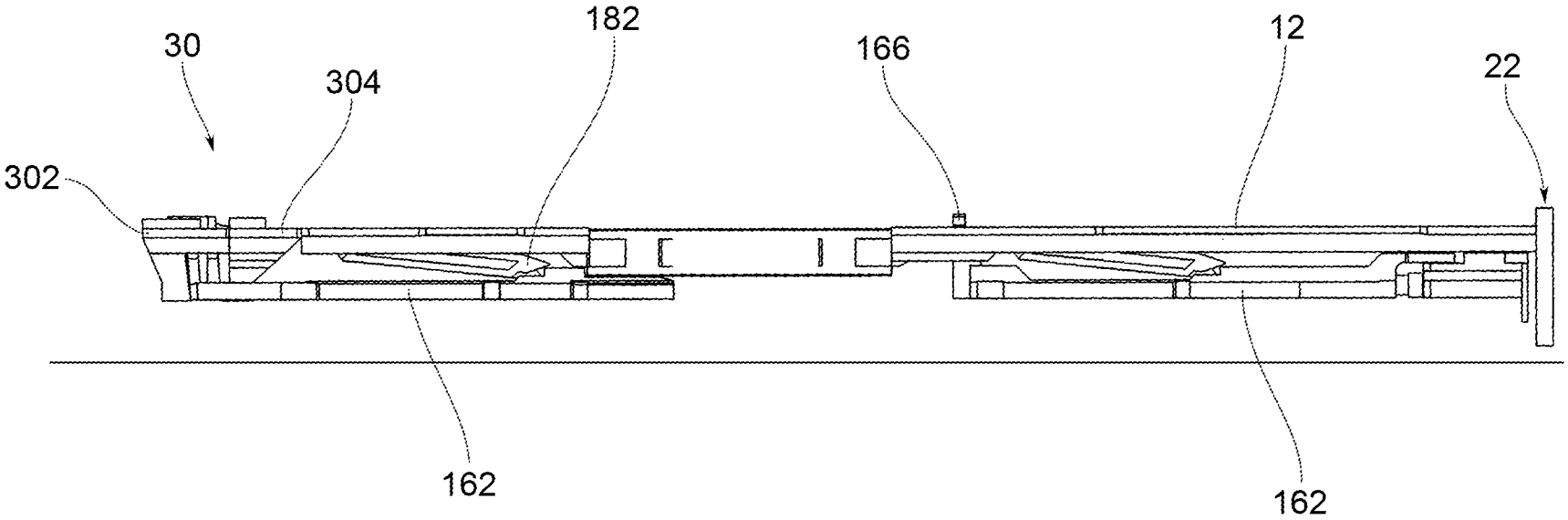
FIG. 3 is a side view of the drop down seal only, in the rest configuration.
Figure 4:
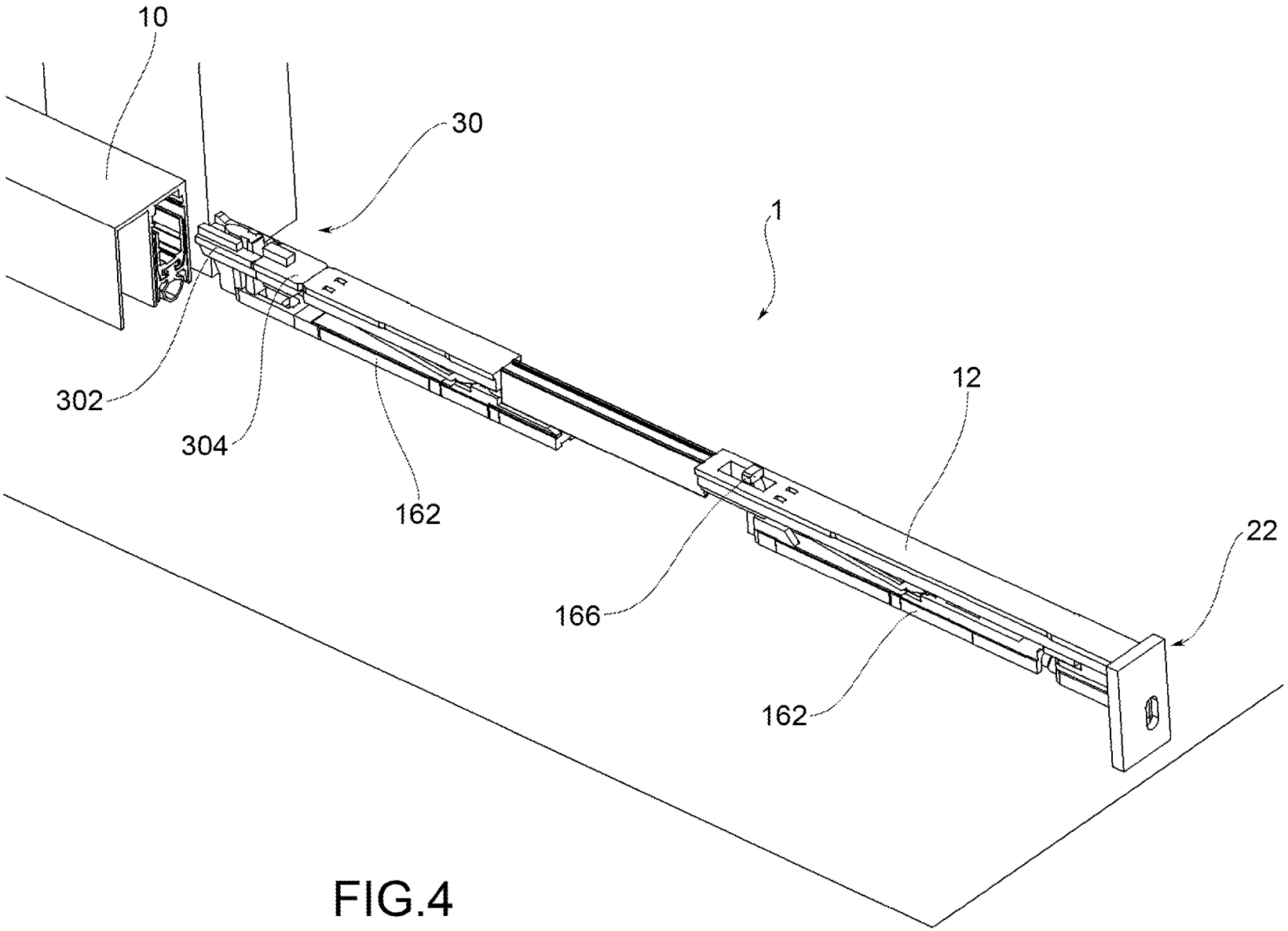
FIG. 4 is a perspective view of the drop down seal in the rest configuration and of the support profile, separated from one another.
Figure 5:
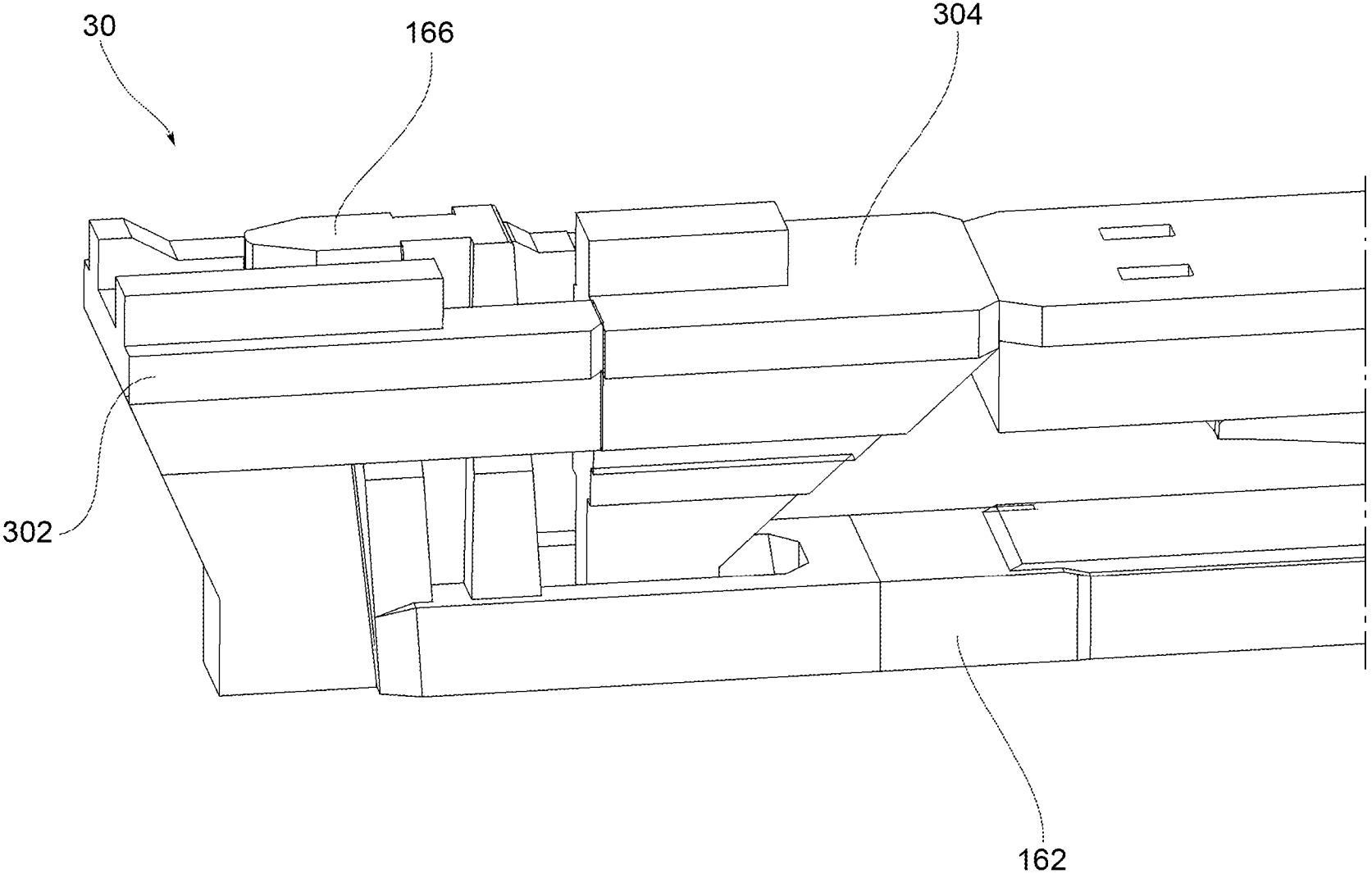
FIG. 5 is an enlarged view of an end portion of the drop down seal in the rest configuration.

As in the example shown in FIG. 1, the drop down seal 1 described below is particularly suitable to be applied to sliding doors 4, in which the panel 5 of the door moves straight along a panel movement axis to open and close the passage.

For the purposes of simplicity, the description below will refer to a horizontal panel movement axis for the movement of the panel and therefore of the drop down seal fixed thereto. Therefore, the movement of the sealing element of the drop down seal in relation to the floor is also defined as a vertical movement.

Furthermore, in the description below, the words “front” and “rear” will be used with reference to the direction of movement of the panel when it moves from the open position of the door or window passage, in which the drop down seal is inactive, to the closed position of the passage, in which the drop down seal is in the working position.

A person skilled in the art will be capable, however, of applying the technical teaching described below, possibly with the appropriate adaptations, not only to other types of doors, in which a movement of the drop down seal in relation to the trigger base 2 can be achieved, but also to windows or flaps in which the panel, and therefore the drop down seal, moves along a vertical axis.

In a general embodiment, the drop down seal 1 comprises a channel-shaped external support profile 10 suitable to be fixed to the base of the panel 5 of a door or window.

A rod-shaped support element 12 is slidably housed in a respective longitudinal seat 14 made in the support profile 10.

The support element 12 can therefore move in the longitudinal seat 14; the support element 12 and the longitudinal seat 14 comprise respective countershaped portions that prevent other movements of the support element 12, in a vertical direction for example.

A movable element 16 is connected to the support element 12 by means of a parallelogram articulation mechanism 18 suitable to enable a move in height of the movable element 16 between a raised rest position and a lowered working position.

This movable element 16, when in a raised rest position, is also operationally and removably connected to the support profile 10, so as to move integrally therewith in the panel-closing phase, as will be described later.

The movable element 16 has at least one sealing gasket 20 suitable to rest on the ground when the movable element is in the lowered working position.

According to one aspect of the disclosure, the support element 12, at one of its proximal ends, forms, or is provided with, a laterally protruding control portion 22 suitable to be engaged by the trigger base 2 fixed to the floor.

For example, the control protrusion 22 is formed by a plate that extends in a plane orthogonal to the panel movement axis.

In the movement of the panel from the open position to the closed position along the panel movement axis, just before reaching the closed position, the movement of the support element 12 is stopped by the trigger base 2 and, due to the effect of the further movement of the support profile 10 and thus of the movable element 16, causes the opening of the parallelogram articulation mechanism 18 and then the lowering of the movable element 16.

In one embodiment, the movable element 16 comprises a pair of movable arms 162 parallel to the support element 12. Each movable support arm 162 is connected to the support element 12 by means of a respective articulation lever 182.

In one embodiment, the movable arms 162 are housed in a movable gasket-holding profile 24 to which is fixed, or that itself forms, the sealing gasket 20.

In one embodiment, the drop down seal 1 comprises, in addition to the distal end of the support element 12, a releasable retaining member 30 configured so as to hold the movable element 16 in a raised position when the panel is in the open position and during the movement towards the closed position, to release the movable element 16 when the support element 12 is blocked by the trigger base 2, and to bring the movable element 16 to the raised position when the panel is pushed towards the open position.

In particular, the releasable retaining member 30 comprises a first jaws 302 integral in movement to the support profile 10 and a second jaws 304 movable in the support profile 10 between a first member-closed position and a second member-open position.

For example, the retaining member 30 is placed in continuation of the support element 12, so as to share the seat thereof in the support profile 10 and thus to be bound to the profile in the vertical direction.

The movable element 16 is provided with a first coupling appendage 164 that extends substantially in a vertical direction between the two jaws 302, 304, so as to be held between the two jaws 302, 304 when the retaining member 30 is closed to keep the movable element 16 in a raised rest position. When the retaining member 30 is open, as will be described later, the movable element 16 is free to move into the lowered working position.

In one embodiment, the two jaws 302, 304 are connected together by connection means 306 suitable to exert a connection force which, in the absence of an external force acting on at least one of the two jaws, greater than said connection force, during the movement of the support profile keeps the two jaws at a mutual distance established by said external force.

In other words, if the retaining member 30 is closed, it remains closed during the movement of the panel, until an external force, which in this case is the reaction force exerted on the second jaws 304 by the coupling appendage 164 when the support element 12 is blocked by the trigger base 2, causes the retraction of the second jaws 304 and therefore the opening of the retaining member 30.

Similarly, if the retaining member 30 is open, for example because the panel is in the passage-closed position, it remains open when the panel begins its return stroke towards the passage-open position, until a reaction force that exceeds the connection force is exerted on the second jaws 304, for example when the second jaws 304 rests against the support element 12 while the latter is still blocked by the trigger base 2, as will be described below.

In one embodiment, the connection means 306 comprise a sliding guide that extends from the first jaws 302 and on which slides the second jaws 304. The connection force can be obtained as a friction force between the second jaws 304 and the sliding guide.

In one embodiment, the first jaws 302 is bound to the support profile 10 by means of a pair of first stop teeth 308 made, for example, as folded tabs in the support profile 10.

In one embodiment, the support profile 10 also forms a second stop tooth 310, for example, it too made as a folded tab, suitable to limit the movement of the second jaws 304 from the first position to the second position.

In one embodiment, the coupling appendage 164 ends at the top in a coupling lip 166 suitable to be inserted between the two jaws 302, 304 when the retaining member 30 is open and which forms an undercut wherein the first jaws 302 is engaged when the retaining member is closed, preventing the lowering of the movable element 16.

As stated above, according to another aspect of the disclosure, the movable element 16 is returned to a raised inactive position by the closing of the retaining member 30 immediately after the start of the movement of the panel towards the open position.

In one embodiment, the surface of the first jaws 302 facing the coupling appendage 164 is shaped so as to create a lifting cam 303, for example an inclined plane, suitable to cause the coupling appendage 164 to rise between the two jaws 302, 304 when the first jaws 302 interacts with the coupling appendage 164 in the lowered position.

Furthermore, as stated above, the coupling appendage 164 is suitable to engage the second jaws 304 to cause the movement thereof into the second position. For example, the coupling appendage 164 has a substantially flat rear surface, facing towards the second jaws 304, suitable to rest on the second jaws 304. For example, in order to reduce the sliding friction between the coupling appendage 164 and the second jaws 304 during the lowering of the movable element 16, the coupling appendage 164 rests on a lower lip 305 of the second jaws 304.

In one embodiment, the movable element 16 comprises a second coupling appendage 168, for example extending vertically from the rear movable arm 162, snap-insertable, or with calibrated interference, or a forced form of connection, in an appendage seat 122 obtained in the support element 12. This connection between the second coupling appendage 168 and the appendage seat 122 contributes to hold the movable element 16 in a raised position, in combination with the retaining member 30, which acts distally, or anteriorly, on the movable element 16. The interference between the second coupling appendage 168 and the appendage seat 122 is chosen however so as to enable the disengagement of the second coupling appendage 168 when the support element 12 is blocked by the trigger base 2.

In one embodiment, the support profile 10 forms a second longitudinal seat 102, parallel to and alongside the longitudinal seat 14, suitable to receive the trigger base 2.

Turning now to the trigger base 2, to be fixed to the abutment surface of the sealing gasket laterally in relation to the drop down seal 1, it is provided with a trigger element 202 suitable to engage the control protrusion 22 of the support element 12 to block the movement thereof.

In one embodiment, the trigger base 2 comprises a base plate 204 comprising a coupling portion 206 and an opposing portion 208. The base plate 204 is rotatable around a vertical axis between an inactive open position, wherein it is disengaged from the support element 12, and an active closed position, wherein the coupling portion 206 is engaged by the control protrusion 22 and the opposing portion 208 is rotated perpendicularly relative to the movement axis of the panel so as to exert on the support element 12 a predetermined force opposing the retraction.

In one embodiment, the base plate 204 is mounted on a rotation pin 210 in such a way as to snap-rotate at least between the open position and the closed position.

Snap rotation means that the base plate 204 tends to remain in its above-described stroke-end positions, open and closed, until a force greater than a predetermined threshold is applied thereto. For example, this predetermined threshold is given by the interaction between radial sectors 208' made in the rotation pin and respective reliefs 204' made in the base plate 204, or vice versa.

In one embodiment the trigger base 2 comprises a fixed part 212, suitable to be fixed to the abutment surface, and a movable part 214 supporting the trigger element 202. The movable part 214 is suitable to move with respect to the fixed part 212 along an adjustment direction parallel to the movement axis of the panel. For this purpose, the trigger base 2 is equipped with an adjustment device 216, for example a screw, suitable to adjust the distance between the fixed part 212 and the movable part 214 so as to adjust the stroke in the vertical direction of the movable element 16 accordingly. In fact, the further apart the two parts of the trigger base, the greater the opening permitted to the parallelogram articulation mechanism, and therefore the greater the move in height of the movable element 16.

It should be noted that the opposing force exerted by the opposing portion 208 on the support element 12 is chosen so as to enable, during the return phase of the panel to the open position, the second jaws 304 to rest against the support element 12 so as to close the retaining member 30 and distance the second stop tooth 310 from the second jaws 304. This opposing force must not be too great, however, so as not to excessively oppose the opening of the panel by the user.

The operation of the drop down seal is described below.

When the flap is in the retracted open, or at least partially open position of the passage (FIGS. 2-5), the drop down seal 1 is completely disengaged from the trigger base 2. The movable element 16 is in the raised inactive position.

The retaining member 30 is closed and in abutment against the distal end of the support element 12.

The second jaws 304 is in the advanced position, or at a distance from the second stop tooth 310.

When the panel is slid towards the advanced passage-closed position, just before reaching the stroke-end position, the support element 12 is intercepted, by means of its control portion 22, by the trigger base 2. The support element 12 then stops its stroke and is placed under stress.

The movable element 16, which is connected to the support element 12 by means of the parallelogram articulation mechanism, is also placed under stress. Since the support profile 10 continues its movement towards the front end-of-stroke position, the retaining member 30, now closed, advances in relation to the support element 12.

At this point, the coupling appendage 164, which is still under stress, exerts on the second jaws 304 a force that overcomes the connection force between the two jaws 302, 304 and causes the second jaws 304 to retract against the second stop tooth 310.

This retraction of the second jaws 304 causes the opening of the retaining member 30 and thus the release of the coupling appendage 164.

Figure 6:
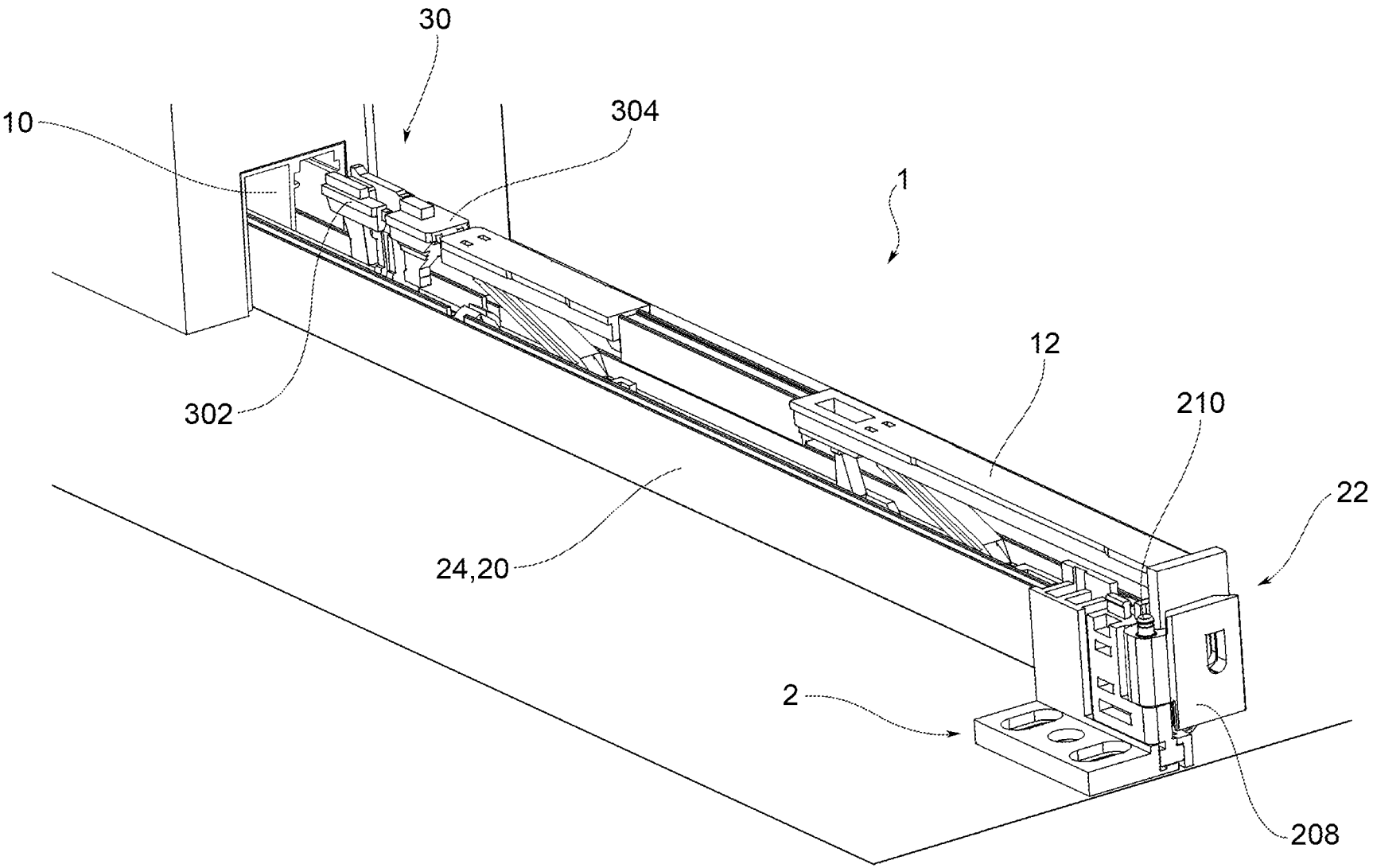
FIG. 6 is a perspective view of the drop down seal in an active configuration, in which the sealing gasket is in the lowered position.
Figure 7:
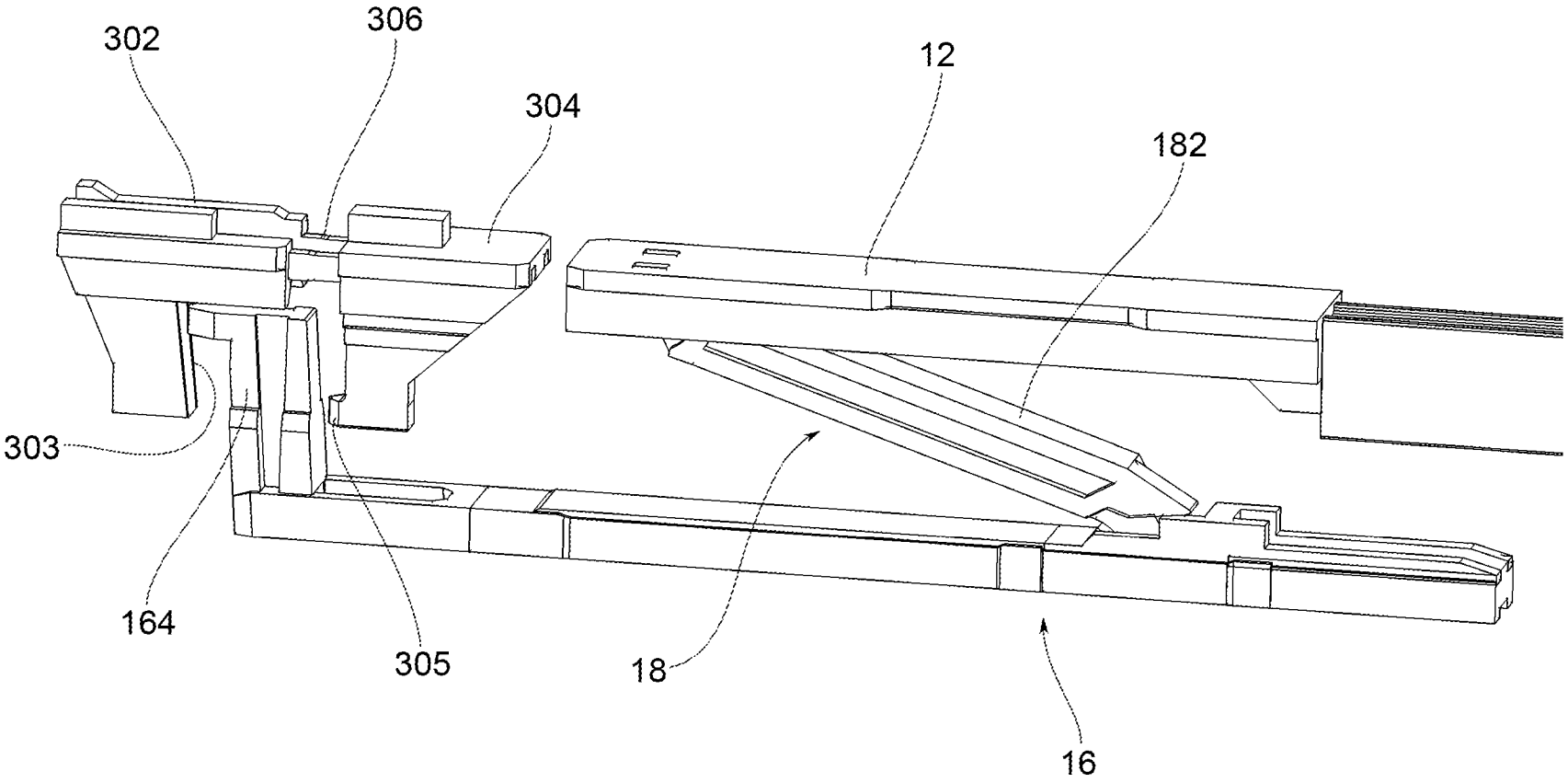
FIG. 7 is an enlarged view of the end portion of the drop down seal in FIG. 6, without the external support profile and gasket-holding profile.
Figure 7A:
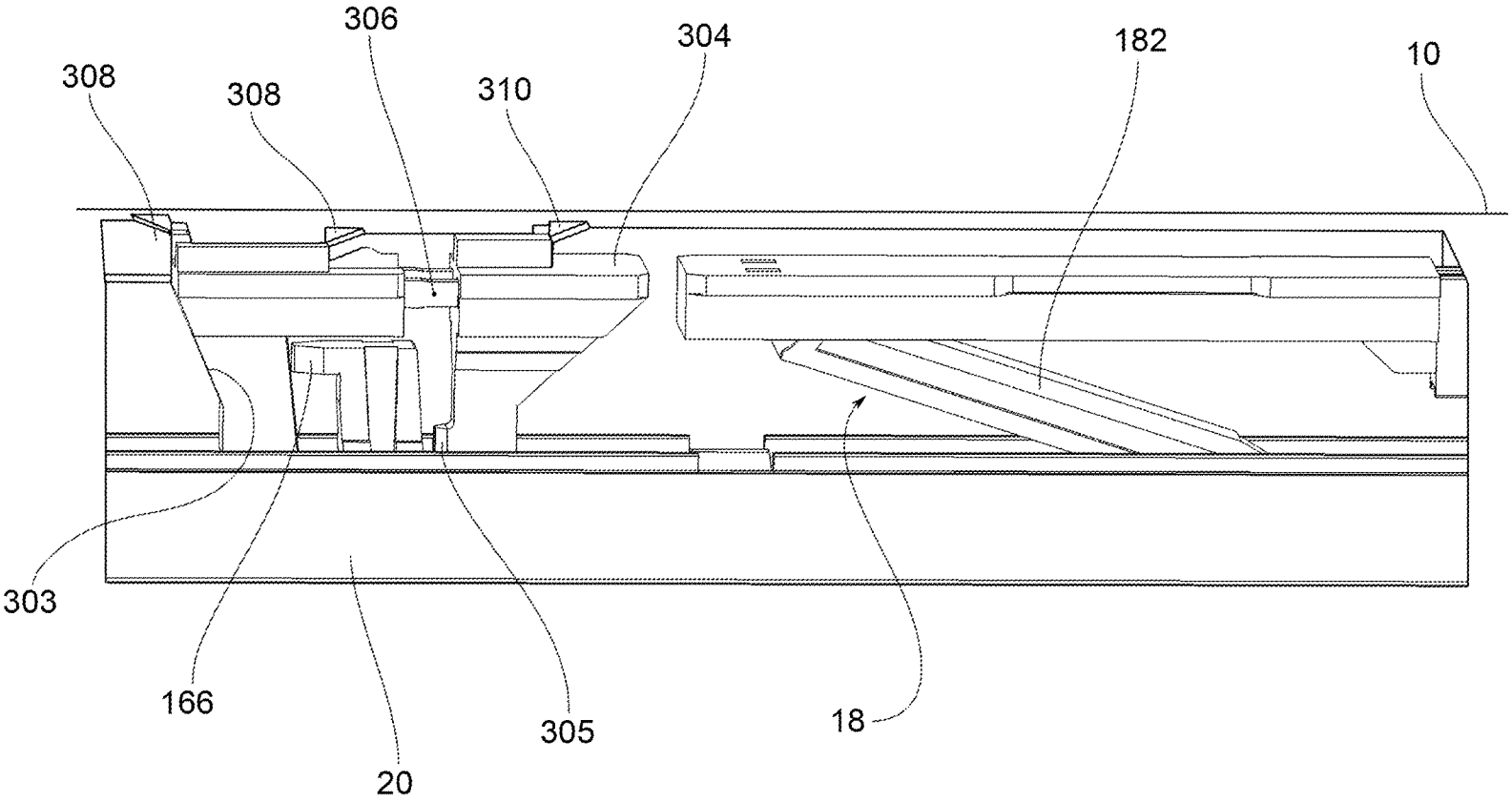
FIG. 7*a* is similar to the previous view, in which the movable element is housed in the respective gasket-holding profile, and in which the external support profile is shown in partial cross-section.

In this configuration of the drop down seal, the residual forward movement of the support profile 10 causes the opening of the articulation mechanism, or the rotation of the articulation levers, and therefore the lowering of the movable element 16 and the relative sealing gasket 20 (FIGS. 6-7*a*).

When the panel is pushed towards the open position, the opposing portion of the trigger member initially keeps the support element 12 blocked.

The retraction of the support profile 10 causes the coupling appendage 164 to rise along the first jaws 302, which acts as a cam, until the coupling lip of the appendage exceeds in height the two jaws 302, 304, which in this initial phase are still open.

Figure 8:
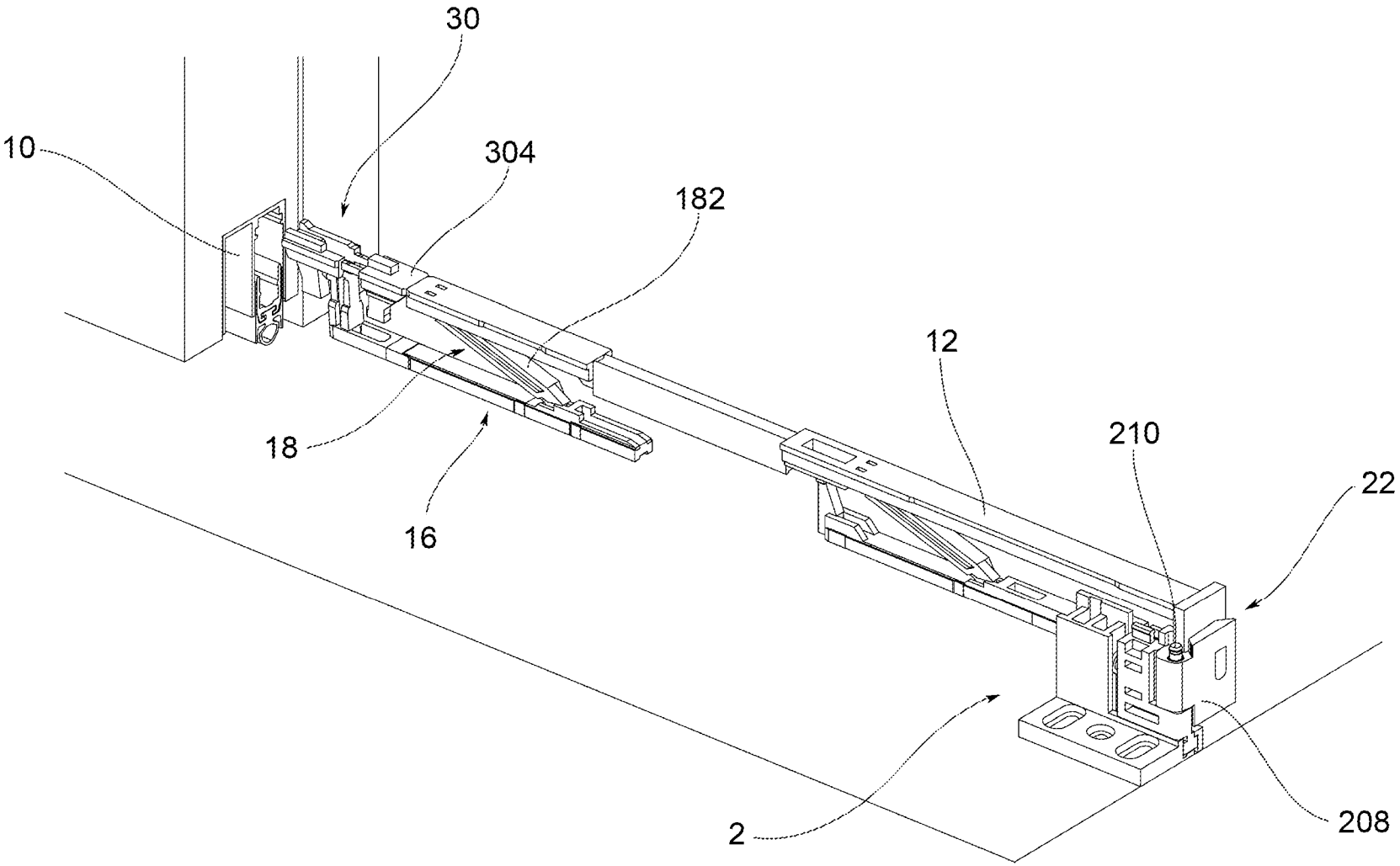
FIG. 8 is a perspective view of the drop down seal, without profiles, and of the trigger base, in an initial phase of the movement of the panel towards the retracted open position.
Figure 9:
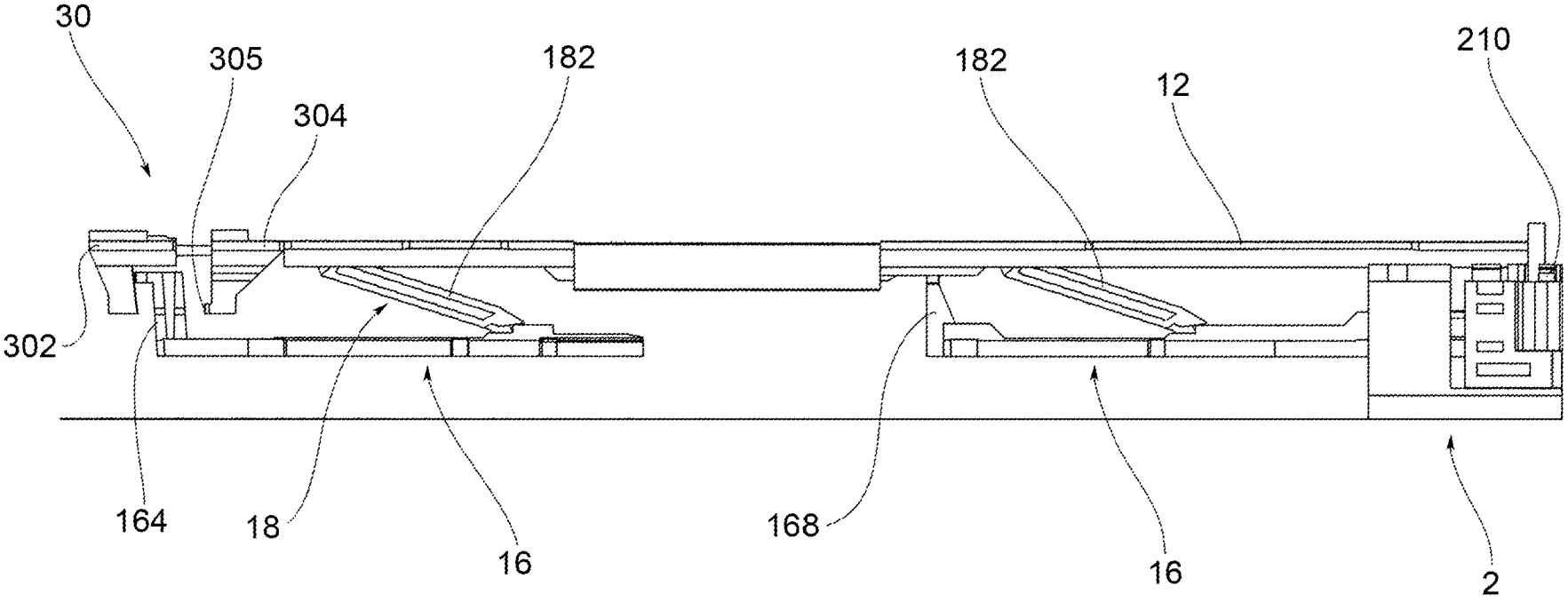
FIG. 9 is a side view of the drop down seal and the trigger base shown in FIG. 8.
Figure 9A:
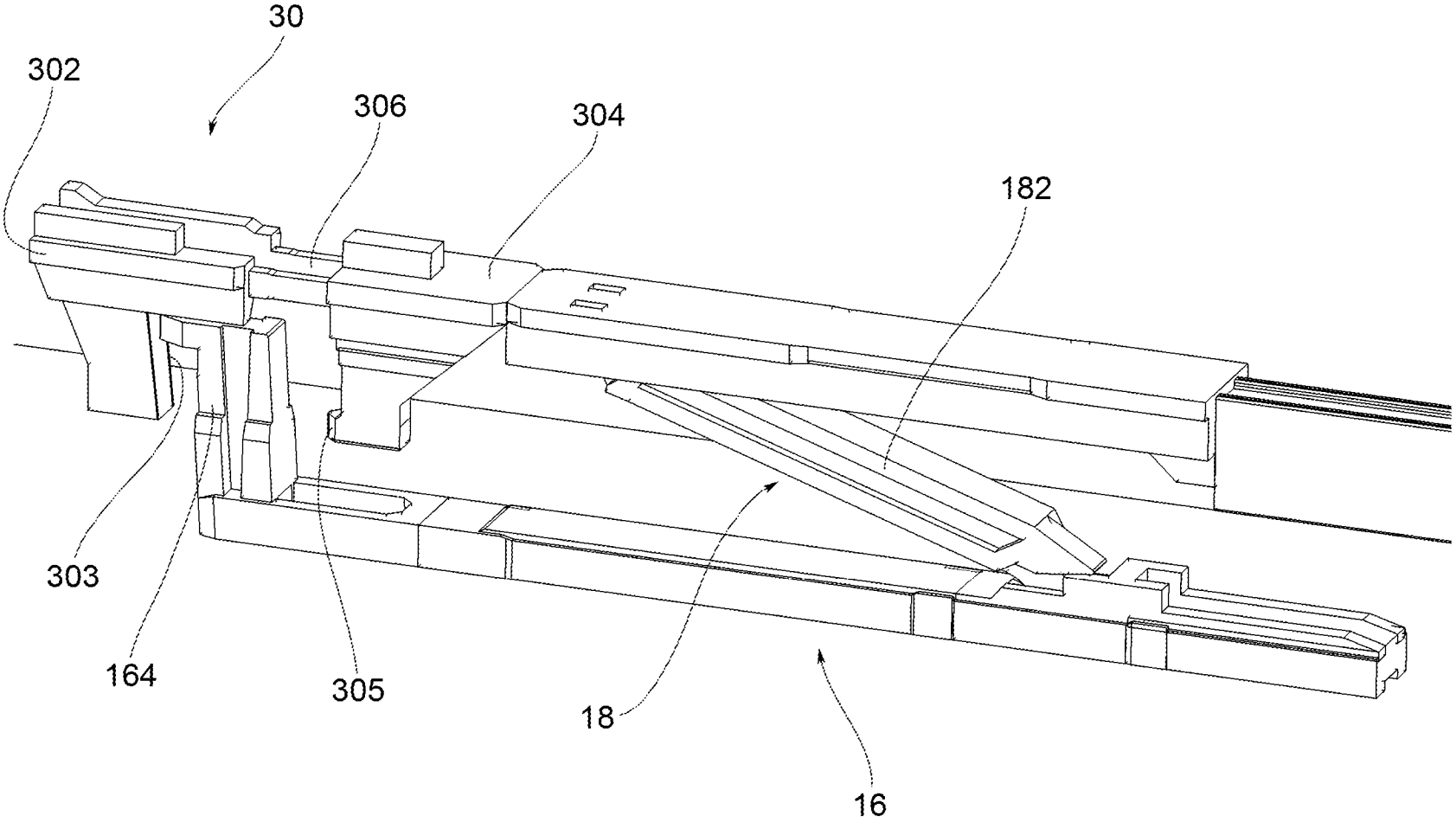
FIG. 9*a* is an enlarged view of the end portion of the drop down seal shown in FIGS. 8 and 9.
Figure 10:
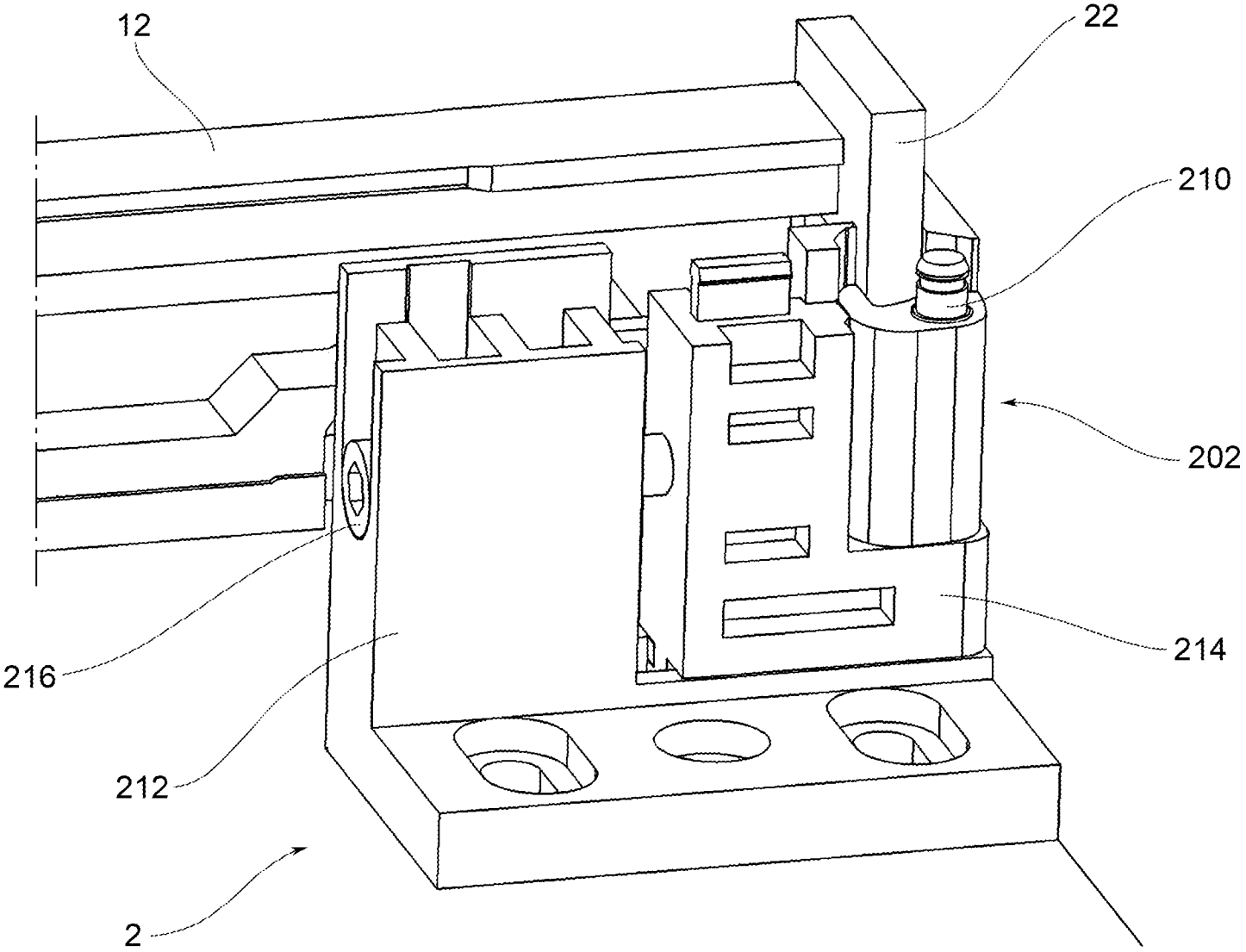
FIGS. 10 and 10*a* are two enlarged perspective views, from opposite sides, of the proximal portion of the drop down seal while it is engaged by the trigger base.
Figure 10A:
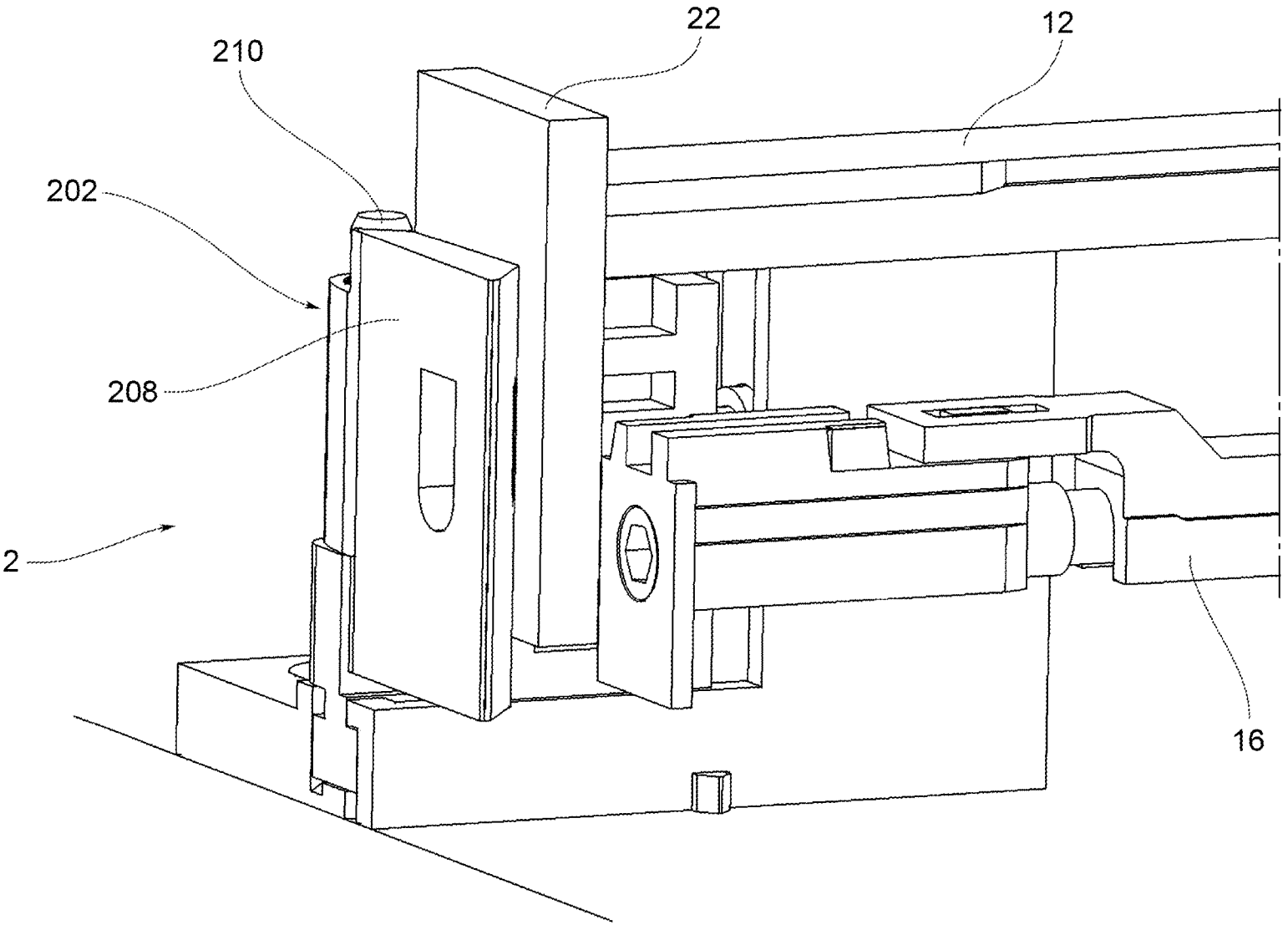
Figure 11:
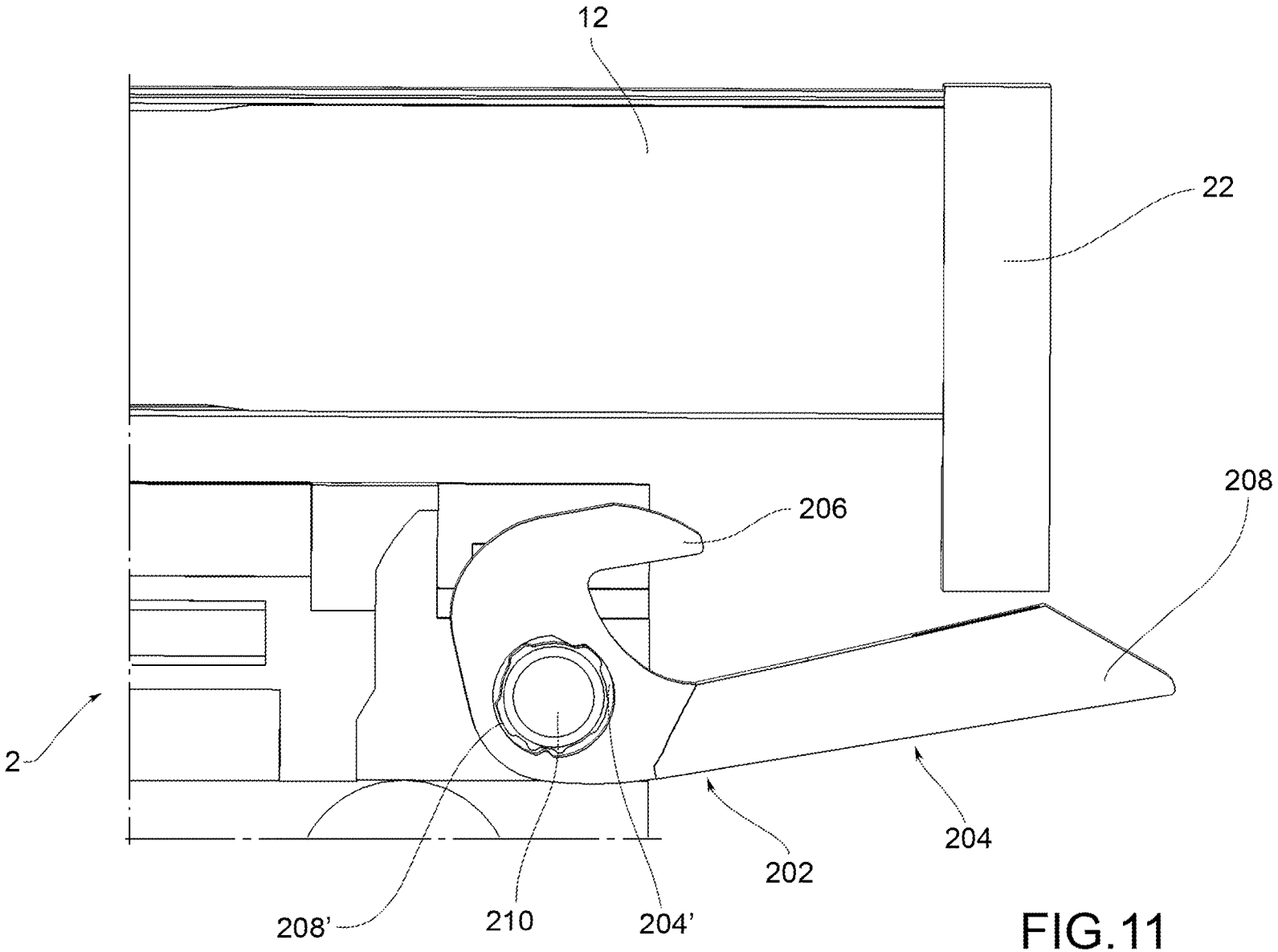
FIG. 11 is a top plan enlarged view of the proximal end portion of the drop down seal in the phase of disengagement from the trigger base.
Figure 12A:
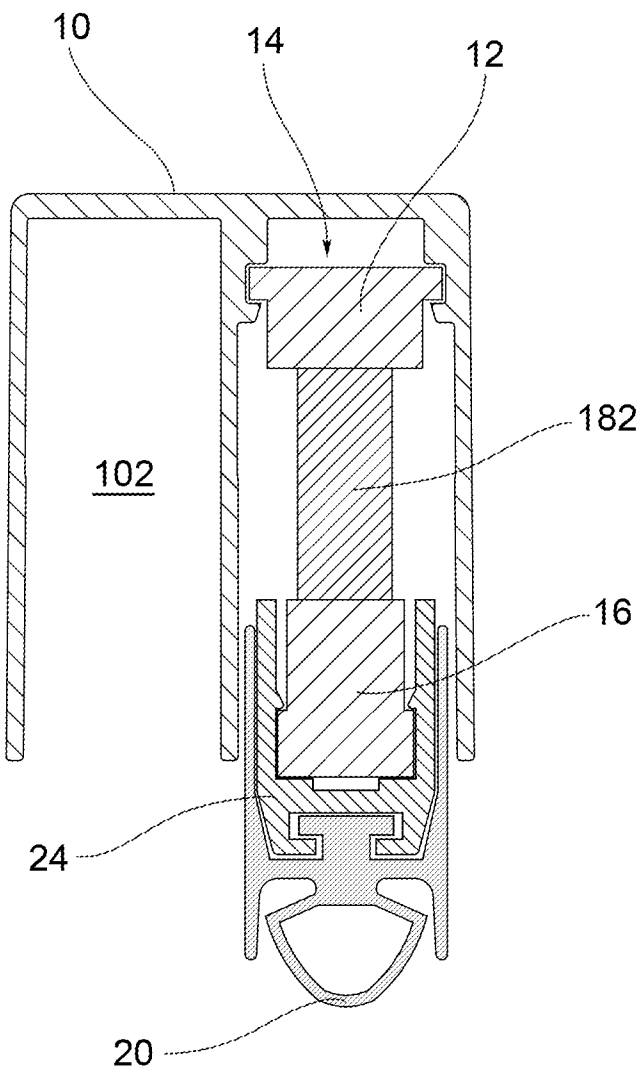
FIGS. 12 and 12*a* are two cross sections of the drop down seal in the two configurations of rest and work respectively.
Figure 12:
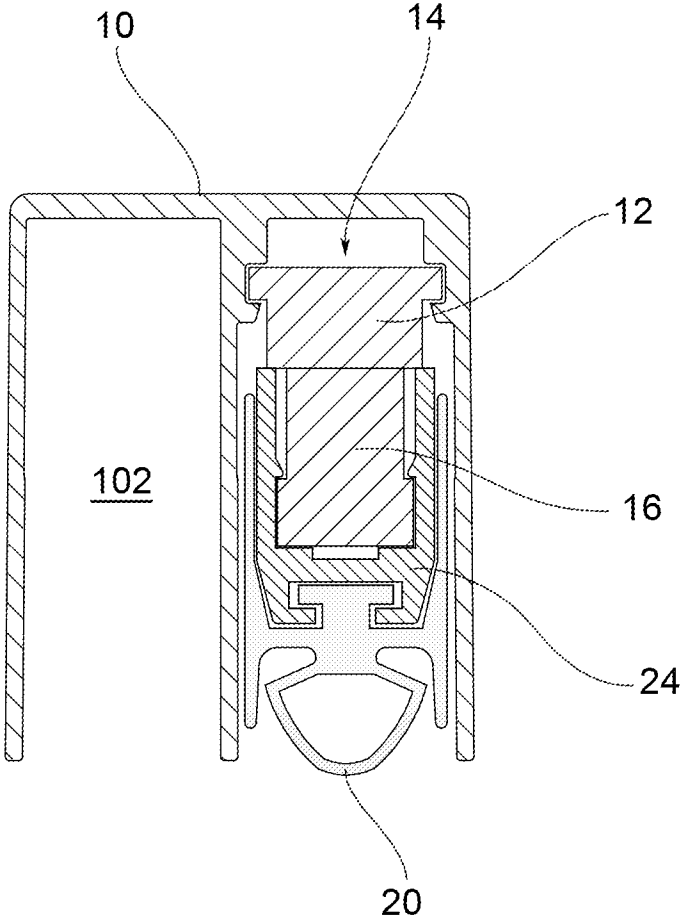

When the second jaws 304 rests against the distal end of the support element 12 (FIGS. 8-9*a*), which is still blocked by the trigger member 2, the further movement of the support profile 10 causes the closing of the retaining member 30 and the distancing of the second stop tooth 310 from the second jaws 304.

In this way, the starting condition of the drop down seal 1 is reset and the further movement of the panel towards the retracted position causes the opening of the trigger element 202, or the rotation of the opposing portion 208, and thus the disengagement of the support element 12 from the trigger base 2.

It should be emphasized that, during the return phase of the panel towards the open position of the passage, the movable element 16 rises to a raised inactive position thanks to the retaining member 30, which acts as a raising cam, and to the equilibrium between the forces in play, particularly the opposing force exerted by the trigger base 2 and the connection force between the two jaws of the retaining member 30.

This makes it possible to avoid the use of springs or other return elements to raise the movable element, these being unusable in the case of sliding doors or windows, particularly without locks.

A person skilled in the art could make modifications to the embodiments of the drop down seal, as well as adaptations and substitutions of elements with others that are operationally equivalent, without departing from the scope of the following claims. Each of the characteristics described as belonging to a possible embodiment can be created independently of the other embodiments described.

The invention claimed is:

1. A drop down seal for doors or windows, in particular doors or windows with sliding panel, the drop down seal comprising:

a channel-shaped external support profile configured to be fixed to a base of a panel of a door or window;

a rod-shaped support element slidably housed in the channel-shaped external support profile;

a movable element connected to the rod-shaped support element by a parallelogram articulation mechanism configured to allow the movable element to move in height between a raised rest position and a lowered working position, said movable element, when in the raised rest position, also being operationally and removably connected to the channel-shaped external support profile; and at least one sealing gasket carried by the movable element and suitable for resting on an abutment surface when said movable element is in the lowered working position, wherein the rod-shaped support element, at a proximal end thereof, forms, or is provided with, a laterally protruding control portion suitable for being engaged by a trigger base fixed to the abutment surface in such a way that, when the panel is moved from an open position to a closed position along a movement axis of the panel, just before reaching the closed position, movement of the rod-shaped support element is stopped by the trigger base and movement of the channel-shaped external support profile causes the movable element to be lowered;

the drop down seal further comprising, beyond a distal end of the rod-shaped support element, a releasable retaining member comprising first jaws integral in movement to the channel-shaped external support profile and second jaws movable in the channel-shaped external support profile between a first member closed position and a second member open position, and wherein the movable element further comprises a first coupling appendage extending in vertical direction between the first and second jaws, so as to be held between the first and second jaws when the releasable retaining member is closed to keep the movable element in the raised rest position, the movable element being free to move into the lowered working position when the releasable retaining member is open.

2. The drop down seal of claim 1, wherein the movable element comprises a pair of movable arms parallel to the rod-shaped support element, each arm of said pair of movable arms being connected to the rod-shaped support element by a respective articulation lever.

3. The drop down seal of claim 2, wherein said pair of movable arms is housed in a movable, gasket-holding profile to which the at least one sealing gasket is fixed.

4. The drop down seal of claim 1, wherein the first and second jaws are connected to each other by connection means configured to exert a connection force which, in the absence of an external force acting on at least one of the first and second jaws that is greater than said connection force during movement of the channel-shaped external support profile, keeps the first and second jaws at a mutual distance established by said external force.

5. The drop down seal of claim 1, wherein the channel-shaped external support profile forms a stop tooth configured to limit movement of the second jaws from the first member closed position to the second member open position.

6. The drop down seal of claim 1, wherein the first coupling appendage ends at the top with a coupling lip configured to be inserted between the first and second jaws when the releasable retaining member is open and which forms an undercut engaging the first jaws when the releasable retaining member is closed, preventing lowering of the movable element.

7. The drop down seal of claim 1, wherein a surface of the first jaws facing the first coupling appendage is shaped in a way to create a lifting cam configured to cause the first coupling appendage to rise between the first and second jaws when the first jaws interacts with the first coupling appendage in the lowered working position.

8. The drop down seal of claim 1, wherein the first coupling appendage is configured to engage the second jaws to cause the second jaws to move into the second member open position.

9. The drop down seal of claim 1, wherein the movable element comprises a second coupling appendage that is snap-insertable or insertable with calibrated interference in an appendage seat obtained in the rod-shaped support element to hold the movable element in the raised rest position.

10. The drop down seal of claim 1, wherein the laterally protruding control portion is formed by a plate that extends in a plane orthogonal to the movement axis of the panel.

* * * * *